US008061325B2

(12) United States Patent
Ishii et al.

(10) Patent No.: US 8,061,325 B2
(45) Date of Patent: Nov. 22, 2011

(54) OIL PAN STRUCTURE AND AN ENGINE THEREWITH

(75) Inventors: Yuki Ishii, Nagasaki-ken (JP); Kazuhiro Yoshizumi, Nagasaki-ken (JP); Naoki Suganuma, Nagasaki-ken (JP); Shinichiro Takahashi, Kanagawa-ken (JP); Ryo Suzuki, Kanagawa-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 397 days.

(21) Appl. No.: 12/289,509

(22) Filed: Oct. 29, 2008

(65) Prior Publication Data

US 2009/0145395 A1 Jun. 11, 2009

(30) Foreign Application Priority Data

Dec. 10, 2007 (JP) ..... 2007-319003

(51) Int. Cl.
*F02B 77/00* (2006.01)

(52) U.S. Cl. ..... 123/195 C; 184/106

(58) Field of Classification Search ..... 123/195 C; 184/106

See application file for complete search history.

(56) References Cited

U.S. PATENT DOCUMENTS

| | | | | | |
|---|---|---|---|---|---|
| 4,296,716 | A * | 10/1981 | Hofbauer et al. | ..... | 123/195 C |
| 4,909,203 | A * | 3/1990 | Fukuo | ..... | 123/196 R |
| 5,531,196 | A * | 7/1996 | Clark | ..... | 123/195 C |
| 7,188,708 | B2 * | 3/2007 | Osman | ..... | 184/106 |
| 7,481,196 | B2 * | 1/2009 | Jessberger | ..... | 123/195 C |
| 2002/0100641 | A1 | 8/2002 | Osman | | |

FOREIGN PATENT DOCUMENTS

| | | | |
|---|---|---|---|
| JP | 58023258 | A * | 2/1983 |
| JP | 59-3146 | | 1/1984 |
| JP | 07293327 | A * | 11/1995 |
| JP | 11-82166 | | 3/1999 |
| JP | 11-270408 | | 10/1999 |
| JP | 11-280548 | | 10/1999 |
| JP | 11270408 | A * | 10/1999 |
| JP | 2002-227626 | | 8/2002 |
| JP | 2002-364324 | | 12/2002 |
| JP | 3925614 | | 3/2007 |

* cited by examiner

*Primary Examiner* — Noah Kamen

(74) *Attorney, Agent, or Firm* — Wenderoth, Lind & Ponack, L.L.P.

(57) ABSTRACT

An oil pan structure includes a plurality of reinforcement beads of several kinds. An engine utilizes the oil pan, whereby the strength and vibration-rigidity (rigidity against vibration) of the oil pan and the engine are sufficiently enhanced so that a natural frequency of the oil pan and the engine therewith becomes adjustable through a selection as to the numbers, locations, and sizes of the beads.

20 Claims, 4 Drawing Sheets

OIL PAN STRUCTURE AND AN ENGINE THEREWITH

BACKGROUND OF THE INVENTION

1. Field of the Invention

The present invention relates to an oil pan structure and an engine therewith whereby the structure comprises: an oil pan flange; a bottom wall that forms a bottom part of an engine; two side walls (i.e. a left side wall and a right side wall) along a longitudinal direction of the engine, each wall that communicates a longitudinal edge of the bottom wall with the oil pan flange; and two side walls (i.e. a front side wall and a rear side wall) along a transverse direction of the engine, each wall that communicates a transverse edge of the bottom wall with the oil pan flange, thereby, the structure forms a boxy space, being capable of storing engine-internal oil therein.

2. Description of the Related Art

Conventionally known oil pan structures comprise: an oil pan flange that is fastened with bolts to the undersurface of the crankcase; a bottom wall that forms a bottom part of an engine; two side walls along a longitudinal direction of the engine, each wall that communicates a longitudinal edge of the bottom wall with the oil pan flange; and two side walls along a transverse direction of the engine, each wall that communicates a transverse edge of the bottom wall with the oil pan flange, whereby, the structure forms a boxy space so that the space can store engine-internal oil therein. In many cases, such an oil pan is manufactured by means of welding thin sheets of metal; thus, the stiffness of the structure is not sufficient. Further, the engine vibration level is high in general. Therefore, various measures to secure the strength as well as to control the vibration have been proposed.

A patent reference 1 (JP1999-280548) discloses an oil pan structure whereby the bottom part is reinforced with a bellow type plate, that is, with a plurality of reinforcement ribs 27, while the left- and right-side walls are provided with a plurality of reinforcement ribs 26, inside the oil pan.

A patent reference 2 (JP 2002-227626) discloses an oil pan structure whereby the bottom part is reinforced with a plurality of reinforcement channels 58, whereby the channels give the bottom part a bellow surface.

A patent reference 3 (JP2002-364324), i.e. a reference 4 (JP 2007 Patent 3925614) discloses an oil pan structure whereby the bottom part is provided with a plurality of reinforcement beads 1*k'*, while the left- and right-side walls, along a longitudinal direction of the engine, are provided with a plurality of reinforcement beads 1*a'*.

A patent reference 5 (JP1999-270408) discloses an oil pan structure whereby the bottom part is provided with a plurality of reinforcement beads along the engine longitudinal direction as well as the engine transverse direction.

In an oil pan structure comprising: an oil pan flange that is fastened with bolts to the undersurface of the crankcase; a bottom wall that forms a bottom part of an engine; two side walls along a longitudinal direction of the engine, thereby each wall communicates a longitudinal edge of the bottom wall with the oil pan flange; and two side walls along a transverse direction of the engine, thereby each wall communicates a transverse edge of the bottom wall with the oil pan flange, whereby, the structure forms a boxy space so that the space can store engine-internal oil therein, the mentioned oil pan is, in many cases, manufactured by means of welding thin sheets of metal.

Thus, the stiffness of the structure is not sufficient; further, the engine vibration level is high in general. As the mentioned patent references 1 to 5 disclose, mainstream measures to secure the strength as well as to control the vibration are based on reinforcement beads which are provided on the bottom part of the oil pan, the left/right side wall along the engine longitudinal direction, or the front/rear side wall along the engine transverse direction.

However, in the mentioned measures according to conventional manners to provide an engine oil pan with reinforcement beads, improvements on strength as well as vibration-reduction are limited in spite of the reinforcement beads. The reason is that the beads are provided independently on the bottom part of the oil pan, on the left/right side wall along the engine longitudinal direction, or on the front/rear side wall along the engine longitudinal direction, whereby the oil pan structure comprises: an oil pan flange that is fastened with bolts to the undersurface of the crankcase, a bottom wall that forms a bottom part of an engine, two side walls along a longitudinal direction of the engine, thereby each wall communicates a longitudinal edge of the bottom wall with the oil pan flange, and two side walls along a transverse direction of the engine, thereby each wall communicates a transverse edge of the bottom wall with the oil pan flange, whereby, the structure forms a boxy space.

Further, it is noted that conventional oil pans are often of a welded structure. The present invention, however, is based on the premise that the oil pan structure is basically a one-piece press-work product.

Moreover, it is noted that the mentioned conventional arts do not disclose how a natural frequency of an oil pan can be adjustable in connection with the shape of the reinforcement beads.

In this specification, a term "bead" is fundamentally used for explanation, so as to clarify that the oil pan walls are provided with corrugation reinforcement. Namely, this invention clearly recognizes a bead as a groove that is provided on a sheet metal by means of press working. A groove may forms a module of corrugation. A plurality of grooves may form continuation of corrugation.

Further, a closed end of a bead is defined as a groove end where the groove disappears toward the original sheet metal, with a trace curve of a U-shape, while an open end or end-opening of the bead means a groove end where the groove disappears toward the original sheet metal, without a trace curve. Sometimes, in this open end or end-opening, the groove disappears three-dimensionally with a shape of a round egg-cone. For this reason, a bead both ends of which are the open end or end-opening is named a substantially egg-shaped bead, in this specification. On the other hand, when one end of a bead is a closed end, the bead is named a substantially U-shaped bead in this specification.

BRIEF SUMMARY OF THE INVENTION

In view of the subjects to be solved in the conventional arts, the present invention is aiming at:

improving strength as well as vibration reduction according to reinforcement beads provided on oil pan structures;

making it possible to adjust natural frequencies of an oil pan in connection with a shape of the reinforcement beads; and realizing an engine and an oil pan thereof, whereby improved strength and vibration-rigidity are secured.

In order to accomplish the mentioned purposes, the present invention discloses an oil pan structure and an engine therewith whereby the structure comprises:

an oil pan flange that is fastened with bolts to the undersurface of an engine crankcase;

a bottom wall that forms a bottom part of an engine;

two side walls (i.e. a left side wall and a right side wall) along a longitudinal direction of the engine, thereby each wall communicates a longitudinal edge of the bottom wall with the oil pan flange; and two side walls (i.e. a front side wall and a rear side wall) along a transverse direction of the engine, thereby each wall communicates a transverse edge of the bottom wall with the oil pan flange, whereby, the structure forms a boxy space, being capable of storing engine-internal oil therein, wherein, the bottom wall as well as the two side walls in the longitudinal direction as to the engine and the two side walls in the transverse direction as to the engine, namely, a bottom wall and four side walls comprise a plurality of reinforcement beads which swell with a corrugation shape, toward the inside space of the oil pan; the reinforcement beads stretch on from the bottom wall to the left- or right-side wall or to the front- or rear-side wall.

In a preferable example (1) according to the present invention, a mentioned reinforcement bead, that is, a first type reinforcement bead, comprises:

a first end-opening which communicates an surface of the bead swelling geometrically-smoothly with the inherent walls of the oil pan without bead provision, i.e. a bottom wall, a side wall along a longitudinal direction, or a side wall along a transverse direction;

a tunnel-shaped part the surface of which swells toward the inside space of the oil pan;

a second end-opening which communicates a surface of the bead swelling geometrically-smoothly with the inherent walls of the oil pan without bead provision, i.e. a bottom wall, a side wall along a longitudinal direction, or a side wall along a transverse direction, whereby the first end-opening, the tunnel-shaped part, and the second end-opening are connected and arranged so as to form an outer appearance of a substantially egg-shape; in addition, the curved surface of the tunnel-shaped part forms a wave up-rise module; further, by means of adjusting the length of the tunnel-shaped part, a natural frequency becomes adjustable.

In another preferable example (2) according to the present invention, a mentioned reinforcement bead, that is, a second type reinforcement bead, comprises:

a closed end which shifts, with a trace line yet with a geometrically-smooth continuation, a surface of the bead swelling toward the inherent walls of the oil pan without bead provision, i.e. a bottom wall, a side wall along a longitudinal direction, or a side wall along a transverse direction;

a tunnel-shaped part the surface of which swells toward the inside space of the oil pan;

an open end which communicates a surface of the bead swelling geometrically-smoothly with the an inherent walls of the oil pan without bead provision, i.e. a bottom wall, a side wall along a longitudinal direction, or a side wall along a transverse direction, whereby the closed end, the tunnel-shaped part, and the open end are connected and arranged so as to form an outer appearance of a substantially U-shaped; in addition, the curved surface of the tunnel-shaped part forms a shape like a wave up-rise module; further, by means of adjusting the length of the tunnel-shaped part, a natural frequency becomes adjustable.

In another preferable example (3) according to the present invention, a drain hole is provided on the bottom wall with the mentioned first and second type beads, whereby a drain cock is fitted to the drain hole as a reinforcement element for the bottom wall.

In a preferable example according to the present invention, a plurality of substantially triangular wave-grooves run on the right- and left-side walls of the oil pan in the engine longitudinal direction, whereby the distance between the two walls is broadened as the location goes upward, and the two walls are communicated through a cross section of the bottom wall; further, the cross section of the substantially triangular wave-grooves forms a continuation of triangle zigzag shape.

From a different view point, in a preferable embodiment (1) according to the present invention, an oil pan structure and an engine therewith whereby the structure comprises:

an oil pan flange that is fastened with bolts to the under-surface of an engine crankcase;

a bottom wall that forms a bottom part of an engine;

two side walls (i.e. a left side wall and a right side wall) along a longitudinal direction of the engine, thereby each wall communicates a longitudinal edge of the bottom wall with the oil pan flange; and two side walls (i.e. a front side wall and a rear side wall) along a transverse direction of the engine, thereby each wall communicates a transverse edge of the bottom wall with the oil pan flange, whereby, the structure forms a boxy space, being capable of storing engine-internal oil therein, wherein, the bottom wall as well as the two side walls in the longitudinal direction as to the engine and the two side walls in the transverse direction as to the engine, namely, a bottom wall and four side walls comprise a plurality of reinforcement beads which swell with a corrugation shape, toward the inside space of the oil pan; the reinforcement beads stretch over on from the bottom wall to the left- or right-side wall or to the front- or rear-side wall.

Further, in this embodiment, a mentioned reinforcement bead, that is, a first type reinforcement bead, comprises:

a first end-opening which communicates an surface of the bead swelling geometrically-smoothly with the an inherent walls of the oil pan without bead provision, i.e. a bottom wall, a side wall along a longitudinal direction, or a side wall along a transverse direction;

a tunnel-shaped part the surface of which swells toward the inside space of the oil pan;

a second end-opening which communicates a surface of the bead swelling geometrically-smoothly with the an inherent walls of the oil pan without bead provision, i.e. a bottom wall, a side wall along a longitudinal direction, or a side wall along a transverse direction, whereby the first end-opening, the tunnel-shaped part, and the second end-opening are connected and arranged so as to form an outer appearance of a substantially egg-shape; in addition, the curved surface of the tunnel-shaped part forms a shape like a wave up-rise module; further, by means of adjusting the length of the tunnel-shaped part, a natural frequency of the oil pan becomes adjustable so that the frequency can be apart from an engine explosion frequency, i.e. an engine first order revolution, or a high order frequency thereof.

Besides the above preferable embodiment (1), in another preferable embodiment (2), an oil pan structure and an engine therewith whereby the structure comprises:

an oil pan flange that is fastened with bolts to the under-surface of an engine crankcase;

a bottom wall that forms a bottom part of an engine;

two side walls (i.e. a left side wall and a right side wall) along a longitudinal direction of the engine, thereby each wall communicates a longitudinal edge of the bottom wall with the oil pan flange; and two side walls (i.e. a front side wall and a rear side wall) along a transverse direction of the engine, thereby each wall communicates a transverse edge of the bottom wall with the oil pan flange, whereby, the structure forms a boxy space, being capable of storing engine-internal oil therein, whereby, the bottom wall as well as the two side walls in the longitudinal direction as to the engine and the two side walls in the transverse direction as to the engine, namely, a bottom wall and four side walls comprise a plurality of reinforcement beads which swell with a corrugation shape, toward the inside space of the oil pan; the reinforcement beads stretch on from the bottom wall to the left- or right-side wall or to the front- or rear-side wall, wherein the mentioned reinforcement bead, that is, a second type reinforcement bead, comprises:

a closed end which shifts, with a trace line yet with a geometrically-smooth continuation, a surface of the bead swelling toward the an inherent walls of the oil pan without bead provision, i.e. a bottom wall, a side wall along a longitudinal direction, or a side wall along a transverse direction;

a tunnel-shaped part the surface of which swells toward the inside space of the oil pan;

an open end which communicates a surface of the bead swelling geometrically-smoothly with the inherent walls of the oil pan without bead provision, i.e. a bottom wall, a side wall along a longitudinal direction, or a side wall along a transverse direction, wherein the closed end, the tunnel-shaped part, and the open end are connected and arranged so as to form an outer appearance of a substantially U-shaped; in addition, the curved surface of the tunnel-shaped part forms a shape like a wave up-rise module; further, by means of adjusting the length of the tunnel-shaped part, a natural frequency becomes adjustable so that the frequency can be apart from an engine explosion frequency, i.e. an engine first order revolution, or a high order frequency thereof.

A reinforcement bead in the present invention is defined as a groove which is formed with a metal sheet that configures an oil pan of an engine, wherein the groove is a strip swelling from the outer periphery surface (a box outer side) of the oil pan toward the inner periphery surface (a box inner side) of the oil pan or from the inner periphery surface (a box inner side) of the oil pan toward the outer periphery surface (a box outer side) of the oil pan.

When the oil pan is manufactured by means of sheet metal press working, the reinforcement bead is formed as a narrow strip swelling from an outer periphery surface of an oil pan side walls or an oil pan bottom wall toward the inner side of the oil pan; or the reinforcement bead is formed as a narrow strip swelling from an inner periphery surface of an oil pan side walls or an oil pan bottom wall toward the outer side of the oil pan.

In an embodiment of the present invention, an oil pan structure (and an engine therewith whereby the structure) comprises:

an oil pan flange that is fastened with bolts to the under-surface of an engine crankcase;

a bottom wall that forms a bottom part of an engine;

two side walls (i.e. a left side wall and a right side wall) along a longitudinal direction of the engine, thereby each wall communicates a longitudinal edge of the bottom wall with the oil pan flange; and two side walls (i.e. a front side wall and a rear side wall) along a transverse direction of the engine, thereby each wall communicates a transverse edge of the bottom wall with the oil pan flange, whereby, the structure forms a boxy space, (being capable of storing engine-internal oil therein), wherein, the bottom wall as well as the two side walls in the longitudinal direction as to the engine and the two side walls in the transverse direction as to the engine, namely, a bottom wall and four side walls comprise a plurality of reinforcement beads which swell with a corrugation shape, toward the inside space of the oil pan; the reinforcement beads stretch on from the bottom wall to the left- or right-side wall or to the front- or rear-side wall.

Further, the reinforcement beads are fitted to all the walls, namely, the bottom wall, the first and second longitudinal side walls, and the first or second transverse side walls; what is more, the reinforcement beads stretch over the bottom wall and the transverse side walls, or the beads stretch over the bottom wall and the longitudinal side walls; namely, each of the beads is fitted so as to always stretch over two walls; thus, the beads are so remarkable to not only improve strength and vibration-rigidity (rigidity against vibration) but also enhance natural frequencies in comparison with conventional manners whereby reinforcement beads are placed independently on a bottom wall, longitudinal side walls, or transverse side walls.

Moreover, since the reinforcement beads stretch over the bottom wall and the transverse side walls, or the beads stretch over the bottom wall and the longitudinal side walls, the beads are effective to not only improve strength and vibration-rigidity but also enhance natural frequencies as to the structure of the oil pan and the engine; thus, a baffle plate welding used in conventional arts to improve strength can be dispensed with; that is, simply with sheet metal drawing (sheet metal press working) an oil pan structure with improved strength and enhanced vibration-rigidity, namely, enhanced natural frequencies as to engine deformations such as engine bending deformation.

Moreover, the substantially egg-shaped bead (a first type reinforcement bead) comprises:

a first end-opening which communicates a surface of the bead swelling geometrically-smoothly with the inherent walls of the oil pan without bead provision, i.e. a bottom wall, a side wall along a longitudinal direction, or a side wall along a transverse direction;

a tunnel-shaped part the surface of which swells toward the inside space of the oil pan;

a second end-opening which communicates a surface of the bead swelling geometrically-smoothly with the inherent walls of the oil pan without bead provision, i.e. a bottom wall, a side wall along a longitudinal direction, or a side wall along a transverse direction, whereby the substantially egg-shaped bead (a first type reinforcement bead) forms an outer appearance of a substantially egg-shape.

Similarly, on the other hand, the substantially U-shaped bead (a second type reinforcement bead) comprises:

a closed end which shifts, with a trace line yet with a geometrically-smooth continuation, a surface of the bead swelling toward the inherent walls of the oil pan without bead provision, i.e. a bottom wall, a side wall along a longitudinal direction, or a side wall along a transverse direction;

a tunnel-shaped part the surface of which swells toward the inside space of the oil pan;

an open end which communicates a surface of the bead swelling geometrically-smoothly with the inherent walls of the oil pan without bead provision, i.e. a bottom wall, a side wall along a longitudinal direction, or a side wall along a transverse direction, whereby the substantially U-shaped bead (a second type reinforcement bead) forms an outer appearance of a substantially U-shape.

According to the above, by means of making changes in the length or the width of the tunnel-shaped part of the substantially egg-shaped bead or in a layout of the beads thereof, or by means of making changes in the length or the width of the tunnel-shaped part of the substantially U-shaped bead or in a layout of the beads thereof, a natural frequency of the bead (either the former bead or the latter bead), by extension of the oil pan or the engine, can be adjustable so that the natural frequency of the structure can be easily apart from a resonance frequency due to engine-operation. Hereby, it is noted that a crankshaft torsional vibration, for example, brings such a resonance frequency.

In an example of this invention, the substantially egg-shaped bead (a first type reinforcement bead) and/or the substantially egg-shaped bead (a first type reinforcement bead) stretch over the bottom wall and the right side wall, or over the bottom wall and the left side wall. In this way, a baffle plate welding used in conventional arts to improve strength/rigidity can be dispensed with; that is, only with sheet metal drawing (press-working), is realized an oil pan structure with improved strength and enhanced vibration-rigidity, namely, enhanced natural frequencies as to engine deformations such as engine bending deformation; further, by means of making changes in the length or the arrangement of the beads, a potential resonance vibration during engine operation can be avoidable; namely, an oil pan, as a whole, with enhanced rigidity can be realized.

In a preferable example according to the present invention, the right and left side walls are placed so that the distance of the two side walls comes nearer as the location goes downward, and a transverse cross section of the walls forms a large egg-shaped curve (a downwardly cone-shaped curve); thus, the oil pan can have side walls of enhanced rigidity and natural frequencies. Further, by means of adjusting the numbers of the beads, the locations of the beads, and the sizes of the beads, a natural frequency can be apart from a resonance frequency.

In a preferable example according to the present invention, a plurality of substantially triangular wave-grooves run on the right- and left-side walls of the oil pan in the engine longitudinal direction, whereby the distance between the two walls is broadened as the location goes upward, and the two walls are communicated through a cross section of the bottom wall; further, the cross section of the substantially triangular wave-grooves forms a continuation of triangle zigzag shape; in addition, the substantially triangular wave-grooves of the zigzag shape are manufactured by means of sheet metal press working.

Therefore, a natural frequency of the engine as to engine bending deformation can be enhanced because of the bead reinforcement effect and press-work hardening. Further, by means of adjusting the amplitude and period of the substantially triangular wave-grooves, a potential resonance vibration during engine operation can be avoidable; in particular, the rigidity of the right-side and left-side walls, by extension, the whole oil pan rigidity is enhanced.

In a preferable example according to the present invention, a drain hole is provided on a broader area of the bottom wall so as to be fitted a drain cock as a reinforcement member. Further, toward a broader area and a narrower area of the bottom wall from the front side wall and the rear side wall, a plurality of the reinforcement beads, hereby the substantially U-shaped beads, are elongated in parallel to the engine longitudinal direction. Thus, the rigidity of the bottom wall including both the broader area with the drain cock and the narrower area with the U-shaped beads is enhanced.

The above-explained oil pan structure can be preferably applied to an oil pan of reciprocating engines with crankshafts, the structure comprising:

an oil pan flange that is fastened with bolts to the undersurface of an engine crankcase and the like;

a bottom wall that forms a bottom part of an engine;

two side walls, i.e. a left side wall and a right side wall, along a longitudinal direction of the engine, thereby each wall communicates a longitudinal edge of the bottom wall with the oil pan flange; and two side walls, i.e. a front side wall and a rear side wall, along a transverse direction of the engine, thereby each wall communicates a transverse edge of the bottom wall with the oil pan flange, whereby, the structure forms a boxy space, being capable of storing engine-internal oil.

BRIEF DESCRIPTION OF THE DRAWINGS

The present invention will now be described in greater detail with reference to the preferred embodiments of the invention and the accompanying drawings, wherein.

The items with numerals in the figures are explained as follows:

1 an oil pan flange;
2 bolts;
3,4 a side wall along a longitudinal direction,
(a first or second longitudinal side wall), or
(a right or left side wall);
5,6 a side wall along a transverse direction,
(a first or second transverse side wall), or
(a front or rear side wall);
7 a bottom wall;
8 an upper side opening;
10 a first bead;
11 a second bead;
12 a third bead;
13 a fourth bead;
14 a fifth bead;
10-14 reinforcement beads;
a substantially egg-shaped bead/a first type reinforcement bead;
15*a* a first end-opening of the bead 15;
15*b* a tunnel-shaped part (a corrugation module) of the bead 15;
15*c* a second end-opening of the bead 15;
16 a substantially U-shaped bead/a second type reinforcement bead;
16*a* a closed end of the bead 16;
16*b* a tunnel-shaped part (a corrugation module) of the bead 16;
16*c* an open end (a first end-opening) of the bead 16;
20 a drain port (a drain hole);
21 an oil outlet;
41 a transverse cross-section of a right or left side-wall of an oil pan as an embodiment of this invention; and

42 a transverse cross-section of a right or left side-wall of an oil pan as an embodiment of this invention.

DETAILED DESCRIPTION OF THE INVENTION

Hereafter, the present invention will be described in detail with reference to the embodiments shown in the figures. However, the dimensions, materials, shape, the relative placement, and so on of a component described in these embodiments shall not be construed as limiting the scope of the invention thereto, unless especially specific mention is placed.

Figure 1:
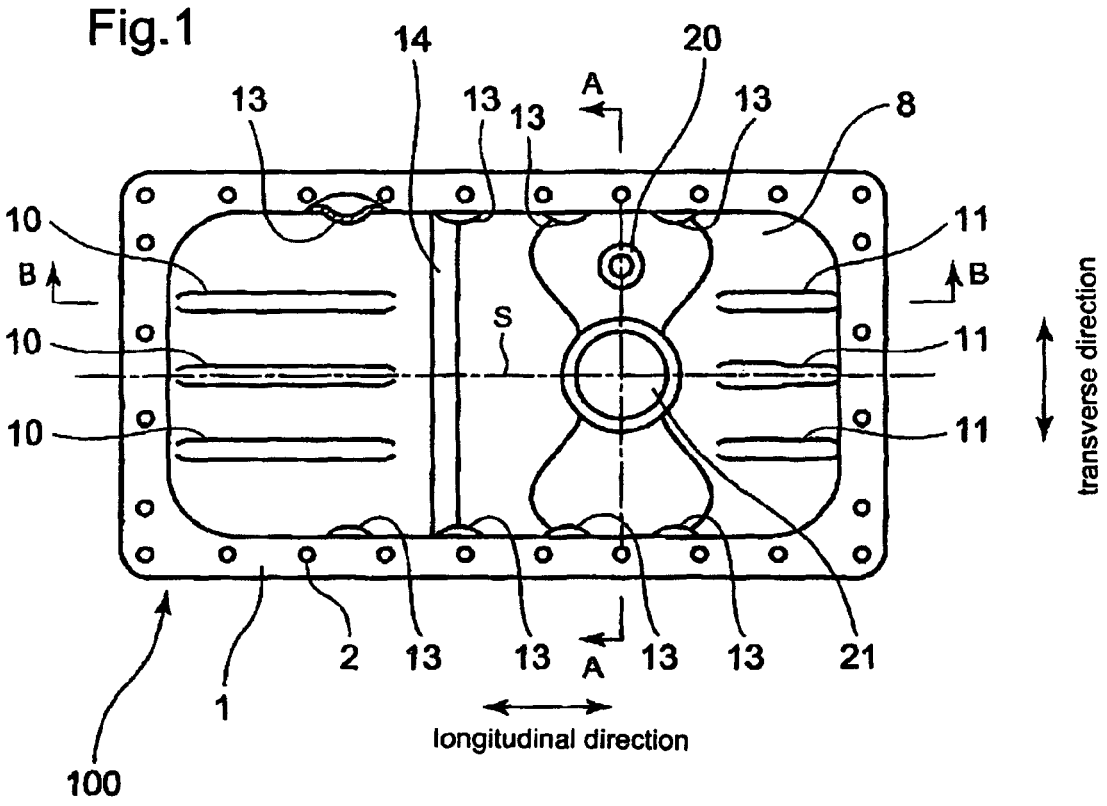
FIG. 1 shows a top view of an oil-pan for small general-purpose engines as to embodiments of the present invention.
Figure 2:
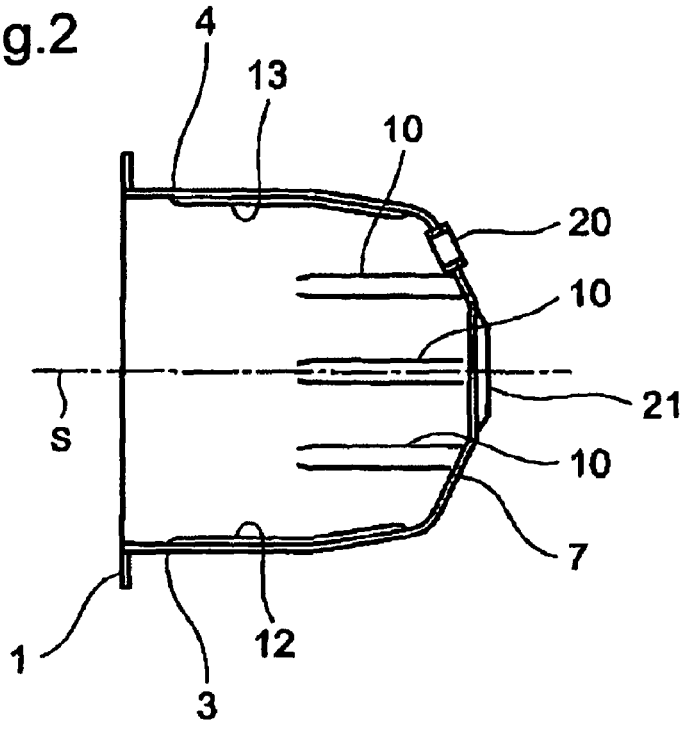
FIG. 2 shows a sectional view along the A-A section in FIG. 1 as to the first embodiment.

FIG. 1 shows a top view of an oil pan for small general-purpose engines as to embodiments of the present invention; FIG. 2 shows a sectional view along the A-A section in FIG. 1 as to the first embodiment; and FIG. 3 shows a sectional view along the B-B section in FIG. 1 as to the first embodiment.

Figure 3:
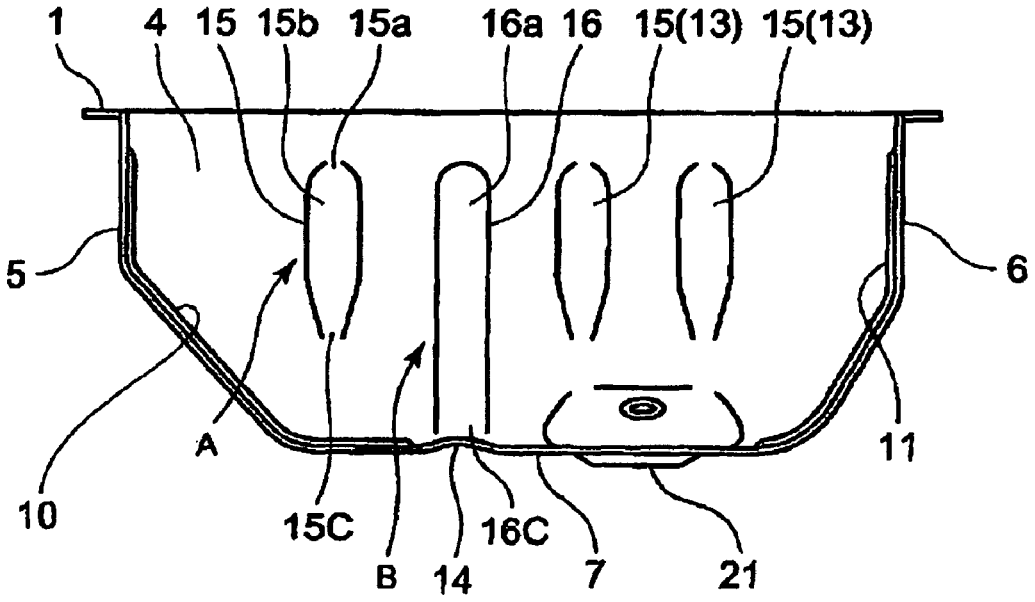
FIG. 3 shows a sectional view along the B-B section in FIG. 1 as to the first embodiment.

In FIGS. 1 to 3, the numeral 100 denotes an oil pan; the structure thereof is as follows.

The oil pan 100 comprises:

an oil pan flange 1 that is fastened with a plurality of bolts 2 to the undersurface of an engine crankcase (not shown);

a bottom wall 7 that forms a bottom part of the engine;

two side walls 3 and 4 (i.e. a left side wall and a right side wall) along a longitudinal direction of the engine, thereby each wall communicates a longitudinal edge of the bottom wall 7 with the oil pan flange; and two side walls 5 and 6 (i.e. a front side wall and a rear side wall) along a transverse direction of the engine, thereby each wall communicates a transverse edge of the bottom wall 7 with the oil pan flange, whereby, the structure with an upper opening 8 forms a boxy space, being capable of storing engine-internal oil which falls down out of the engine into the boxy space. In addition, the symbol S in FIGS. 1 and 2 denotes a center plane, i.e. a longitudinal median plane.

The mentioned oil pan is provided with a plurality of reinforcement beads.

As shown in FIG. 3, a first bead 10 stretches on from the bottom wall 7 to a first transverse side wall 5, and a second bead 11 stretches on from the bottom wall 7 to a second transverse side wall 6.

As shown in FIG. 2, a third bead 12 stretches on from the bottom wall 7 to a first longitudinal side wall 3, and a fourth bead 13 stretches on from the bottom wall 7 to a second longitudinal side wall 4.

As shown in FIG. 1, a fifth bead 14 goes across the bottom wall 7 in the transverse direction so as to reach both the first longitudinal side wall 3 and the second longitudinal side wall 4.

Further, the mentioned beads 10 to 14 are provided so that each of the beads 10 to 14 is either a substantially egg-shaped bead 15 or a substantially U-shaped bead, as occasion demands.

Figure 4:
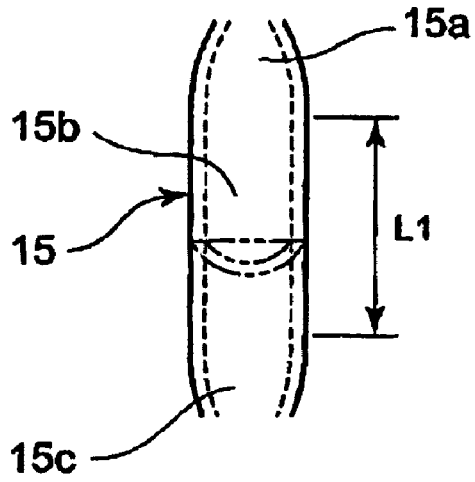
FIG. 4 shows an enlarged front view of a substantially egg-shaped bead as to the first embodiment.

As shown in FIG. 4, the substantially egg-shaped bead 15 comprises:

a first end-opening 15*a* which communicates a surface of the bead swelling geometrically-smoothly with the inherent walls of the oil pan without bead provision, i.e. a bottom wall, a side wall along a longitudinal direction, or a side wall along a transverse direction;

a tunnel-shaped part 15*b* the surface of which swells toward the inside space of the oil pan;

a second end-opening 15*c* which communicates a surface of the bead swelling geometrically-smoothly with the inherent walls of the oil pan without bead provision, i.e. a bottom wall, a side wall along a longitudinal direction, or a side wall along a transverse direction, whereby the substantially egg-shaped bead 15 (a first type reinforcement bead) forms an outer appearance of a substantially egg-shape. In addition, the surface of the tunnel-shaped part 15*b* forms a shape like a wave up-rise module. Namely, the part 15*b* forms a module of metal sheet corrugation.

Accordingly, by means of making changes in the length L1 or the width of the part 15*b* or in a layout of the part 15*b*, a natural frequency of the bead 15, by extension to a natural frequency of the oil pan can be adjustable.

Figure 5:
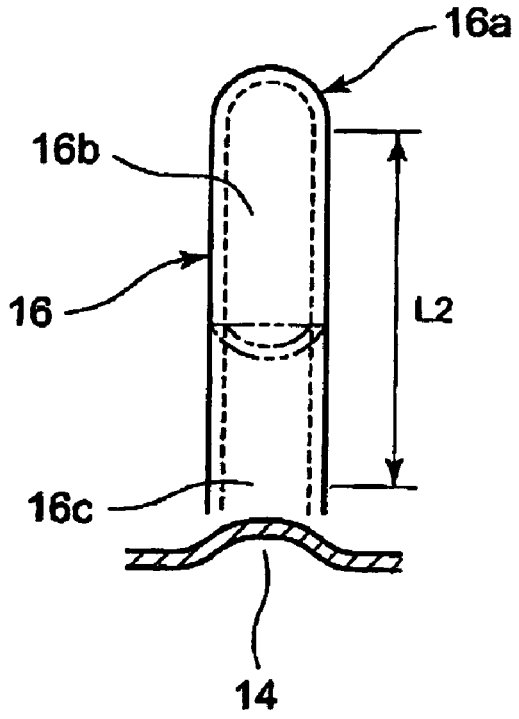
FIG. 5 shows an enlarged front view of a substantially U-shaped bead as to the first embodiment.

On the other hand, as shown in FIG. 5, the substantially U-shaped bead 16 comprises:

a closed end 16*a* which shifts, with a trace line yet with a geometrically-smooth continuation, a surface of the bead swelling toward the inherent walls of the oil pan without bead provision, i.e. a bottom wall, a side wall along a longitudinal direction, or a side wall along a transverse direction;

a tunnel-shaped part 16*b* the surface of which swells toward the inside space of the oil pan;

an open end 16*c* which communicates a surface of the bead swelling geometrically-smoothly with the inherent walls of the oil pan without bead provision, i.e. a bottom wall, a side wall along a longitudinal direction, or a side wall along a transverse direction, whereby the substantially U-shaped bead 16 (a second type reinforcement bead) forms an outer appearance of a substantially U-shape. In addition, the surface of the tunnel-shaped part 16*b* forms a shape like a wave up-rise module. Namely, the part 15*b* forms a module of metal sheet corrugation.

Accordingly, by means of making changes in the length L2 or the width of the part 16*b* or in a layout of the parts 16, a natural frequency of the bead 16, by extension to a natural frequency of the oil pan can be adjustable.

As shown in FIG. 1, in the bottom wall 7 where the mentioned reinforcement beads such as a bead 10 are placed, are provided a drain port 20 and an oil outlet 21.

A drain cock (not shown) which is fitted to the drain port 20 also acts as a reinforced element for the bottom wall 7.

Therefore, by means of providing a plurality of reinforcement beads 10 and 11 so that the beads stretch on, in parallel to the longitudinal direction i.e. in parallel to the first and second longitudinal side walls 3 and 4, from the first transverse side wall 5 as well as from the second transverse side wall 6 toward the bottom wall 7, the oil pan of the present invention is reinforced not only a broader part of the oil pan, the part comprising of the bottom wall 7 where the drain cock is fitted, and the first or second transverse side walls 5 or 6, but also a narrower part of the oil pan, the part comprising of the substantially U-shaped beads 10 and 11, and the first or second transverse side walls 5 or 6.

Namely, the rigidity of the oil pan can be enhanced.

According to the embodiment described thus far, the reinforcement beads such as the bead 10 are fitted to all the walls, namely, the bottom wall 7, the first and second longitudinal side walls 3 and 4, and the first or second transverse side walls 5 and 6; what is more, the reinforcement beads such as the bead 10 stretch over the bottom wall 7 and the transverse side walls 5 and 6, or the beads stretch over the bottom wall 7 and the longitudinal side walls 3 and 4; namely, each of the beads is fitted so as to always stretch over two walls; thus, the beads such as the bead 10 are effective to not only improve strength and vibration-rigidity but also enhance natural frequencies; moreover, an oil pan structure according to the embodiment can be formed easily through sheet metal press working rather than according to conventional manners; furthermore, according to the embodiment, the improvement on strength and vibration-rigidity is remarkable in comparison with a conventional structure whereby reinforcement beads are placed independently on a bottom wall, longitudinal side walls, or transverse side walls.

As already described, since the reinforcement beads such as the bead 10 stretch over the bottom wall 7 and the transverse side walls 5 and 6, or the beads stretch over the bottom wall 7 and the longitudinal side walls 3 and 4, the beads such as the bead 10 are effective to not only improve strength and vibration-rigidity but also enhance natural frequencies. Accordingly, a baffle plate welding used in conventional arts to improve strength can be dispensed with; that is, only with sheet metal drawing, is realized an oil pan structure with improved strength and enhanced vibration-rigidity, namely, enhanced natural frequencies as to engine deformations such as engine bending deformation.

Also as already described, the substantially egg-shaped bead 15 comprises:

a first end-opening 15*a* which communicates a surface of the bead swelling geometrically-smoothly with the inherent walls of the oil pan without bead provision, i.e. a bottom wall, a side wall along a longitudinal direction, or a side wall along a transverse direction (such as walls 3,4,5 or 6 without bead provision);

a tunnel-shaped part 15*b* the surface of which swells toward the inside space of the oil pan;

a second end-opening 15*c* which communicates a surface of the bead swelling geometrically-smoothly with the inherent walls of the oil pan without bead provision, i.e. a bottom wall, a side wall along a longitudinal direction, or a side wall along a transverse direction (such as walls 3,4,5 or 6 without bead provision), whereby the substantially egg-shaped bead (a first type reinforcement bead) 15 forms an outer appearance of a substantially egg-shape. In addition, the surface of the tunnel-shaped part 15*b* forms a surface like that of a bedpan Similarly, the substantially U-shaped bead 16 comprises:

a closed end 16*a* which shifts, with a trace line yet with a geometrically-smooth continuation, a surface of the bead swelling toward the inherent side walls of the oil pan without bead provision, i.e. a bottom wall, a side wall along a longitudinal direction, or a side wall along a transverse direction (such as walls 3,4,5 and 6 without bead provision);

a tunnel-shaped part 16*b* the surface of which swells toward the inside space of the oil pan;

an open end 16*c* which communicates a surface of the bead swelling geometrically-smoothly with the inherent walls of the oil pan without bead provision, i.e. a bottom wall, a side wall along a longitudinal direction, or a side wall along a transverse direction (such as walls 3,4,5 and 6 without bead provision), whereby the substantially U-shaped bead 16 forms an outer appearance of a substantially U-shape. In addition, the surface of the tunnel-shaped part 16*b* forms a surface like that of a bedpan.

Therefore, by means of making changes in the length L1 or the width of the part 15*b* or in a layout of the parts 15, or by means of making changes in the length L1 or the width of the part 16*b* or in a layout of the parts 16, a natural frequency of the bead (either bead 15 or bead 16) can be adjustable so that the natural frequency of the structure can be easily apart from a resonance frequency due to engine-operation.

Thus, the substantially egg-shaped bead (a first type reinforcement bead) and/or the substantially U-shaped bead (a second type reinforcement bead) stretch over the bottom wall and the right side wall, or over the bottom wall and the left side wall. In this way, a baffle plate welding used in conventional arts to improve strength/rigidity can be dispensed with; that is, only with sheet metal drawing (press-working), is realized an oil pan structure with improved strength and enhanced vibration-rigidity, namely, enhanced natural frequencies as to engine deformations such as engine bending deformation; further, by means of making changes in the length or the arrangement of the beads, a potential resonance vibration during engine operation can be avoidable; namely, an oil pan, as a whole, with enhanced rigidity can be realized.

Figure 6:
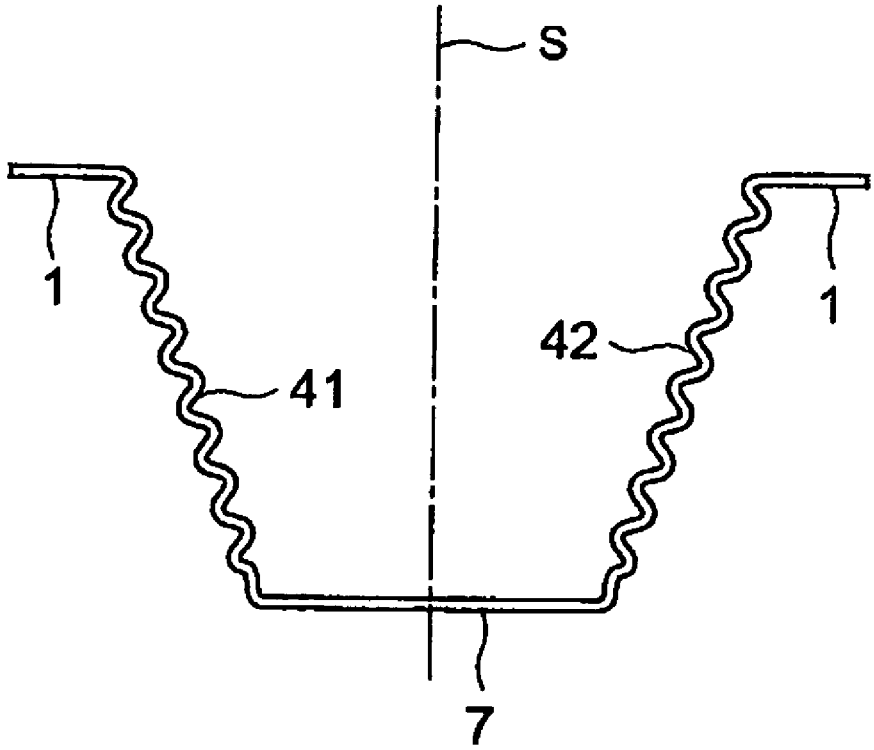
FIG. 6 relates to the second embodiment of the present invention and shows a schematic section structure of an oil-pan for small general-purpose engines.

As to an second embodiment of the present invention, FIG. 6 shows a schematic transverse sectional view of an oil pan for small general-purpose engines.

In this embodiment, a plurality of substantially triangular wave-grooves run on the right- and left-side walls of the oil pan in the engine longitudinal direction, whereby the distance between the two walls is broadened as the location goes upward, and the two walls are communicated through a cross section of the bottom wall 7, as shown in FIG. 6; moreover, the mentioned reinforcement beads such as the substantially U-shaped beads or the substantially egg-shaped beads are provided on the bottom wall 7 and the front- and rear-side wall; further, the cross section 41 or 42 of the substantially triangular wave-grooves forms a continuation of triangle zigzag shape; in addition, the substantially triangular wave-grooves of the zigzag shape are manufactured by means of sheet metal press working.

According to the above embodiment, a natural frequency of the engine as to engine bending deformation can be enhanced because of the bead reinforcement effect and press work hardening. Further, by means of adjusting the amplitude and period of the substantially triangular wave-grooves, a potential resonance vibration during engine operation can be avoidable; in particular, the rigidity of the right-side and left-side walls, by extension, the whole oil pan rigidity is enhanced.

The present invention can be applied to all the oil pans which are able to store engine-oil therein. Thus, the invention is preferable especially to the oil pans for small general-purpose engines.

The present invention realizes an oil pan and an engine therewith whereby enhanced strength and vibration-resistance are secured so that a plurality of reinforcement beads are provided on the oil pan surfaces, the beads themselves being effectively strong for the structure and rigid enough for vibration; further, natural frequencies of the oil pan can be adjusted by means of changing the size or shape of the beads.

The invention claimed is:

1. An oil pan structure for an engine, the oil pan structure comprising:

an oil pan flange for being fastened with bolts to an under-surface of an engine crankcase;

a bottom wall that forms a bottom part of an engine;

a left side wall and a right side wall extending in a longitudinal direction of the engine, a front side wall and a rear side wall extending in a transverse direction of the engine, wherein each of the left side wall, the right side wall, the front side wall, and the rear side wall extends between an edge of the bottom wall and the oil pan flange such that the oil pan structure defines an internal space and is capable of storing engine-internal oil that is stirred in the internal space, wherein each of the bottom wall, the left side wall, the right side wall, the front side wall, and the rear side wall comprises a plurality of reinforcement beads which swell at a middle part thereof with a corrugation shape toward the internal space of the oil pan structure, wherein the reinforcement beads extend from the bottom wall toward the left or right side wall, or from the bottom wall toward the front or rear side wall, and wherein the reinforcement beads are substantially U-shaped beads which each comprise a closed end, a tunnel-shaped part, and an open end, the tunnel-shaped part being disposed at a middle part of the reinforcement bead and swelling toward the internal space of the oil pan structure, and the closed end forming a smooth transition between the tunnel-shaped part of the reinforcement bead and a surface of the oil pan structure.

2. An engine comprising the oil pan structure of claim 1.

3. An engine comprising:

a crankcase; and the oil pan structure of claim 1 fastened to an undersurface of the crankcase.

4. The engine of claim 3, wherein a length of the tunnel-shaped parts of the reinforcement beads is set such that the natural frequency of the oil pan structure is different than a resonance frequency of the engine.

5. The oil pan structure according to claim 1, wherein the internal space is substantially box-shaped.

6. The oil pan structure according to claim 1, wherein a length of the tunnel-shaped parts of the reinforcement beads is set such that the natural frequency of the oil pan structure is different than a resonance frequency of the engine.

7. The oil pan structure according to claim 1, wherein a drain hole is provided in the bottom wall, and a drain cock is fitted to the drain hole as a reinforcement element for the bottom wall.

8. An oil pan structure for an engine, the oil pan structure comprising:

an oil pan flange for being fastened with bolts to an undersurface of an engine crankcase;

a bottom wall that forms a bottom part of an engine;

a left side wall and a right side wall extending in a longitudinal direction of the engine, a front side wall and a rear side wall extending in a transverse direction of the engine, wherein each of the left side wall, the right side wall, the front side wall, and the rear side wall extends between an edge of the bottom wall and the oil pan flange such that the oil pan structure defines an internal space and is capable of storing engine-internal oil that is stirred in the internal space, wherein each of the bottom wall, the left side wall, the right side wall, the front side wall, and the rear side wall comprises a plurality of reinforcement beads which swell at a middle part thereof with a corrugation shape toward the internal space of the oil pan structure, wherein the reinforcement beads extend from the bottom wall toward the left or right side wall, or from the bottom wall toward the front or rear side wall, wherein the reinforcement beads each comprise a first end-opening, a tunnel-shaped part, and a second end-opening, the tunnel-shaped part being disposed at a middle part of the reinforcement bead and swelling toward the internal space of the oil pan structure, and the first and second end-openings being smaller in width than the tunnel-shaped part.

9. An engine comprising the oil pan structure of claim 8.

10. An engine comprising:

a crankcase; and the oil pan structure of claim 8 fastened to an undersurface of the crankcase.

11. The engine of claim 10, wherein a length of the tunnel-shaped parts of the reinforcement beads is set such that the natural frequency of the oil pan structure is different than a resonance frequency of the engine.

12. The oil pan structure according to claim 8, wherein the internal space is substantially box-shaped.

13. The oil pan structure according to claim 8, wherein a length of the tunnel-shaped parts of the reinforcement beads is set such that the natural frequency of the oil pan structure is different than a resonance frequency of the engine.

14. The oil pan structure according to claim 8, wherein a drain hole is provided in the bottom wall, and a drain cock is fitted to the drain hole as a reinforcement element for the bottom wall.

15. An oil pan structure for an engine, the oil pan structure comprising:

an oil pan flange for being fastened with bolts to an undersurface of an engine crankcase;

a bottom wall that forms a bottom part of an engine;

a left side wall and a right side wall extending in a longitudinal direction of the engine, a front side wall and a rear side wall extending in a transverse direction of the engine, wherein each of the left side wall, the right side wall, the front side wall, and the rear side wall extends between an edge of the bottom wall and the oil pan flange such that the oil pan structure defines an internal space and is capable of storing engine-internal oil that is stirred in the internal space, wherein each of the bottom wall, the left side wall, the right side wall, the front side wall, and the rear side wall comprises a plurality of reinforcement beads which swell at a middle part thereof with a corrugation shape toward the internal space of the oil pan structure, wherein the reinforcement beads extend from the bottom wall toward the left or right side wall, or from the bottom wall toward the front or rear side wall, and wherein a plurality of substantially triangular wave-grooves are disposed on the left side wall and the right side wall of the oil pan structure and extend in the longitudinal direction, wherein a distance between the left side wall and the right side wall increases in a direction from the bottom wall toward the oil pan flange, wherein the left side wall and the right side wall are connected by the bottom wall, and wherein the cross section of the substantially triangular wave-grooves forms a zigzag shape.

16. An engine comprising the oil pan structure of claim 15.

17. An engine comprising:

a crankcase; and the oil pan structure of claim 15 fastened to an undersurface of the crankcase.

18. The engine of claim 17, wherein a length of tunnel-shaped parts of the reinforcement beads is set such that the natural frequency of the oil pan structure is different than a resonance frequency of the engine.

19. The oil pan structure according to claim 15, wherein the internal space is substantially box-shaped.

20. The oil pan structure according to claim 15, wherein a drain hole is provided in the bottom wall, and a drain cock is fitted to the drain hole as a reinforcement element for the bottom wall.

* * * * *